United States Patent [19]

Nagai et al.

[11] Patent Number: 4,708,924

[45] Date of Patent: Nov. 24, 1987

[54] PRESSURE FIXABLE MICROCAPSULE TYPE TONER

[75] Inventors: Tatsuo Nagai; Shinichi Suzuki; Hiroshi Yamazaki, all of Hino, Japan

[73] Assignee: Konishiroku Photo Industry Co., Ltd., Tokyo, Japan

[21] Appl. No.: 813,618

[22] Filed: Dec. 26, 1985

Related U.S. Application Data

[63] Continuation of Ser. No. 582,531, Feb. 22, 1984, abandoned.

[30] Foreign Application Priority Data

Mar. 2, 1983 [JP] Japan ..... 58-32850

[51] Int. Cl.[4] ..... G03G 9/00

[52] U.S. Cl. ..... 430/138; 430/98

[58] Field of Search ..... 430/138, 98, 106.6

[56] References Cited

U.S. PATENT DOCUMENTS

| | | | |
|---|---|---|---|
| 3,429,827 | 2/1969 | Ruus | 430/138 |
| 3,974,078 | 8/1976 | Crystal | 430/109 |
| 4,016,099 | 4/1977 | Wellman et al. | 430/138 |
| 4,400,456 | 8/1983 | Matsuda et al. | 430/138 |

*Primary Examiner*—John L. Goodrow

*Attorney, Agent, or Firm*—Frishauf, Holtz, Goodman & Woodward

[57] ABSTRACT

Disclosed is a pressure fixable microcapsule type toner constituted of a core material and an outer wall covering over said core material, which comprises containing in said core material at least a combination of a substance (a) having a glass transition point within the range of from −90° C. to 5° C. with a substance (b) having a softening point within the range of from 25° C. to 180° C. The substance (a) and the substance (b) each may also be a mixed substance system having a glass transition point or a softening point as the whole system within the range as specified above, respectively.

19 Claims, 1 Drawing Figure

PRESSURE FIXABLE MICROCAPSULE TYPE TONER

This is a continuation, of application Ser. No. 582,531filed Feb. 22, 1984 now abandoned.

BACKGROUND OF THE INVENTION

This invention relates to a toner for development of electrostatic images, more particularly to a microcapsule type toner which can preferably be used as the pressure fixing type.

In recent years, according to electrophotography, electrostatic printing or electrostatic recording, it has widely been practiced to form an image based on image information, develop the image with a toner as developer to give a toner image and then fixing the toner image, generally after transferring the toner image to a transfer paper, thereby forming a visible image.

In the prior art, as the toner for development of electrostatic images, use is made widely of powdery toners comprising thermoplastic resins as binders having incorporated colorants such as carbon black, etc. dispersed therein. If it is a two-component toner, it is stirred together with carriers such as iron powder, glass beads, etc., while the toner itself is stirred in the case when it is a one-component toner containing fine powder of magnetic material thereby to effect triboelectric charging, of which electrostatic force is utilized for development of electrostatic charges and the resultant toner image is, for example, transferred and thereafter fixed by heating with a heating roller, etc.

However, in such a toner, toner particles will be broken during stirring for triboelectric charging to form fine powdery toner. As the result, the quality of the visible images obtained will become inferior or exchange of the toner for new one may be required at earlier stage. Moreover, for accomplishing fixing according to heating fixing system, a long waiting time is necessary before the temperature of the fixer reaches a desired setting temperature and an enormous amount of energy is required for heating. Further, there also may be trouble such as the danger of fire when jamming of papers occurs. Besides, to ensure achievement of fixing, it is necessary to satisfy considerably severe conditions with respect to temperature conditions and others.

Under the situation as described above, investigations have recently been made about so-called microcapsules for use as the toner for development of electrostatic images. This microcapsule type toner is a powdery material comprising colored particles encapsulating a fluid core material or a soft solid within microparticulate resin capsules. When this toner is employed, fixing can be effected by applying pressure by means of a pressing roller thereby to have the capsules ruptured, so to speak, whereby no heating is required to alleaviate greatly the problems in heating fixing as described above.

As such pressure fixable microcapsule type toners, various techniques have been known as disclosed in Japanese Unexamined Patent Publication Nos. 91724/1976, 119937/1977, 118249/1979 and 64251/1980. However, problems such as off-set to pressurizing roller, durability, stability and storability remain to be solved. In particular, in pressure fixing onto a plain paper, the problems are great and there are also a number of tasks to be overcome.

More specifically, the fixing component within a microcapsule type toner may be too rigid or contrariwise susceptible to plastic deformation, giving no satisfactory fixing in either case. Also, in a capsule type toner of which microcapsule core material is prepared according to the crushing step of a soft solid, it is necessary to take a manufacturing procedure requiring cooling of the solid during crushing. Further, recourse is sometimes made to the method for encapsulation of a soft material by means of a two-nozzle atomizer which is actually very difficult to handle. Thus, there are involved a large number of problems in production other than fixing characteristic.

The present inventors have made extensive studies to solve such various problems and obtained the knowledge described below. The process of pressure fixing of a microcapsule toner by means of a pressurizing roller generally comprises first rupturing of the outer wall of the capsule by pressurization, then flowing out of the inner core material and pressure fixing of the core flowed out onto the member for fixing. During this process, fixing is effected with the core material participating primarily in pressure fixing being in the form including also the ruptured outer wall therein.

When a core material is fixed onto a member for fixing, the fixing mechanism may be considered to proceed first by way of primary bonding, namely bonding between atoms of both, or secondary bonding, namely intermolecular bonding between both, or further anchoring effect, etc., subsequently or simulataneously followed by coalescing process between core material and core material, core material and outer wall, and outer wall and outer wall, namely mutually between toners, which process may also be considered to proceed according to substantially the same fixing mechanism as described above.

Concerning pressure fixing, when the fixing component in the toner has a very low viscosity, in the case of using, for example, paper as the member for fixing, a visible image can be formed with satisfactory fixing by penetration from its surface fiber into the inner portion. At the same time, however, off-set to the pressurizing roller or penetrability into the outer wall are also high to ensure problems in storability and stability. On the other hand, when the fixing component in the toner has low penetrability, for examble, a high viscosity, it prevents not only fixing onto the member for fixing, but also drop-off of the toner from the member for fixing through coalescence between toners in its fixing mechanism.

Accordingly, for obtaining high pressure fixing characteristics, it is required to increase the effective contact area between toners and the member for fixing and also the effective contact area between toners, and also at the same time required to prevent drop-off of the toners from the member for fixing or drop-off of the toners once sufficiently contacted through the self-agglomerating force of the fixing component itself of the toner.

The present inventors have made extensive studies in view of the facts as mentioned above and have found a technique to improve the pressure fixing characteristic of a microcapsule toner by incorporating a substance having a glass transition point (hereinafter abbreviated as Tg) within the range of from −90° C. to 5° C. as the constituent of the core material based on the discovery that the visco-elastic characteristics of the pressure fixing component in the toner are controlling factors in the fixing characteristic of the toner. Further, as the result of further progress of the study, it has been found to be greatly effective in taking a greater effective contact area and providing high self-agglomerating force of the toner, respectively, to incorporate a substance having a Tg in the range of from −90° C. to 5° C. and a substance having a softening point (hereinafter abbreviated as Tsp) within the range of from 25° C. to 180° C. as the pressure fixing components in the constituents for core material, thus providing a toner which exhibits very high fixing characteristic.

In this context, as the technique referring to the glass transition point in the capsule toner of the prior art, there is known the technique disclosed in Japanese Unexamined Patent Publication No. 17739/1974. However, this technique gives only general description about the relation between the glass transition point and the fixing characteristic, and suggests no technical thought as disclosed in this invention that fixing characteristic is attempted to be improved by incorporating a substance or a mixed substance system having a glass transition point within specific range and a substance or a mixed substance having a softening point within specific range.

SUMMARY OF THE INVENTION

This invention has been accomplished on the basis of the knowledge as mentioned above and its object is to provide a microcapsule type toner having excellent pressure fixing characteristic.

The pressure fixable microcapsule type toner of this invention is constituted of a core material and an outer wall covering over said core material, which comprises containing in said core material at least a combination of a substance having a glass transition point within the range of from -31 90° C. to 5° C. or a mixed substance system having a glass transition point as the whole system within the range as specified above, with a substance having a softening point within the range of from 25° C. to 180° C. or a mixed substance system having a softening point as the whole system within the range as specified above.

DESCRIPTION OF PREFERRED EMBODIMENTS

Figure 1:
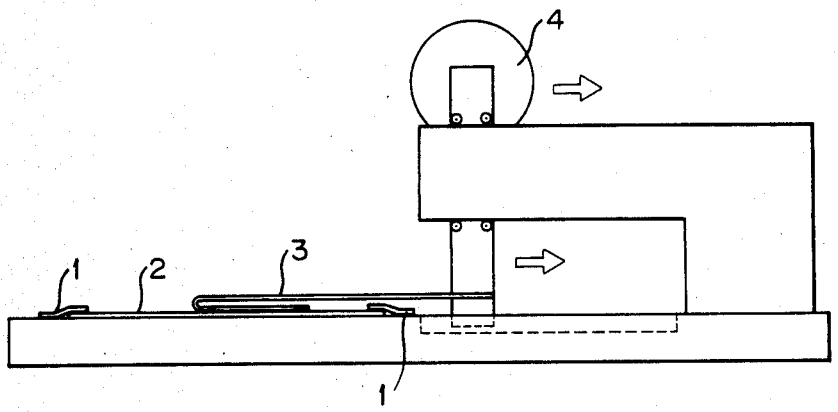
FIG. 1 shows a schematic illustration of a tester used in comparative tests for evaluation of the fixing characteristic.

In the present specification, Tsp represents one of the general characteristics known in this field of the art and it can be measured as follows. For example, using a so-called Koka-type flow tester "Model CFT-500" produced by Shimadzu Corporation, measurement is conducted under the conditions of a load of 20 Kg/cm, a nozzle diameter of 1 mm, a nozzle length of 1 mm, pre-heating at 80° C. for 10 minutes, a temperature elevation speed of 6° C./min. and a sample quantity of 1 cm (weight represented by true specific gravity × 1 cm). The plunger drop of the flow tester is recorded versus temperature to obtain a plunger drop-temperature curve (softening melt-flow curve) and the height of the S-curve in said curve is defined as h. The temperature corresponding to h/2 in the S-curve is defined as Tsp.

The substances to be contained in the core material in this invention may comprise a combination of the single substances falling within the ranges of Tg and Tsp as specified above, respectively, or a combination of mixed substances having as the respective whole systems Tg and Tsp values within the ranges as specified above. Alternatively, it is also possible to use a combination of which one is a single substance and the other is a mixed substance system.

The substance as a constituent in the whole systems having the two kinds of Tg and Tsp, respectively, as specified above refers to a substance, which itself has Tg or Tsp value outside the specified range but can be admixed with a plasticizer to give a combination of mixed substances having a Tg value or Tsp value falling within said range.

In other words, since this invention attempts to improve fixing characteristic by regulating the constituents of the core material in a microcapsule type toner by the two kinds of parameters of Tg and Tsp, not only a combination of single substances, but also a combination of mixed substance systems or a combination of a single substance and a mixed substance system are also included as parallel concepts of the technical thought.

Accordingly, in the case of polymers, they are not restricted to single compounds of homopolymers, copolymers, graft polymers and block polymers, but even mixed substance systems such as micro-blend polymers, polymer/plasticier systems, etc. may also be included, provided that they have Tg within the range of from −90° C. to 5° C., preferably from −80° C. to −10° C., or Tsp within the range of from 25° C. to 180° C., preferably from 35° to 170° C. If Tg and Tsp are outside said ranges, extremely bad fixing will be expected to be brought about.

By permitting these two kinds of substances to be co-present, high pressure fixing characteristic can be exhibited. In addition, more preferable fixing characteristic can be exhibited by controlling their proportions appropriately, namely 30 to 90 parts by weight for the substance or the mixed substance system having a Tg within the range of from −90° C. to 5° C. and 10 to 70 parts by weight for the substance or the mixed substance system having a Tsp within the range of from 25° C. to 180° C. as the constituents in the core material.

It is also possible to incorporate one or more kinds of substances having Tg and Tsp values outside the ranges of this invention in the core material, provided that the effect of this invention is not impaired thereby.

Among the above substances to be contained in the core material in this invention, the single substance having a Tg within the range of from −90° C. to 5° C. may include polymers of dienes such as polymer of 1-chloro-1-butenylene (−40° C. to −20° C.), isoprene (−73° C. to −58° C.), 1-butenylene (−58° C.) or the like; polymers of alkenes such as polymer of butene (−24° C.), isobutylene (−73° C.), isohexylethylene (−34° C.), propylene (−13° C. to −8° C.) or the like; polymers of acrylates such as polymer of butyl acrylate (−54° C.), sec-butyl acrylate (−22° C.), iso-butyl acrylate (−24° C.), ethyl acrylate (−24° C.), 2-ethylhexyl acrylate (−50° C.), heptyl acrylate (−60° C.), 2,2,3,3,5,5,5-heptafluoro-4-oxapentyl acrylate (−55° C.), hexyl acrylate (−57° C.), dodecyl acrylate (−3° C.) or the like; polymers of methacrylates such as polymer of decyl methacrylate (−70° C.), dodecyl methacrylate (−65° C.), hexyl methacrylate (−5° C.), 2-ethylhexyl methacrylate (−10° C.) or the like; polymers of vinyl ethers such as polymer of butyl vinyl ether (−55° C.), 2-ethylhexyl vinyl ether (−66° C.), methyl vinyl ether (−31° C.) or the like; polymers of styrene derivatives such as polymer of 4-(2-butoxy-ethoxy)methylstyrene (−38° C.), 4-decylstyrene (−65° C.), 4-octyloxymethylstyrene (−42° C.) or the like; polymers of urethanes such as polymer of oxy-2-butenyleneoxycarbonyl iminohexamethyleneiminocarbonyl (−44° C. to −39° C.), oxy-2-butenyleneoxycarbonyliminohexamethyleneiminocarbonyl (−45° C.), oxy-2,2-diethyltrimethyleneoxycarbonylimino-4-methyl-1,3-phenyleneiminocarbonyl (−60° C.) or the like; polymers of siloxanes such as polymer of oxymethyl-3,3,3-trifluoropropylsilylene (−80° C.), oxymethylphenylsilylene (−86° C.) or the like. Further, there are also rubbers styrene-butadiene rubber, acrylonitrile-butadiene rubber, ethylene-propylene rubber and the like. These may be used either singly or as a mixture.

The monomers as mentioned above may be copolymerized in a suitable combination, together with or without other monomer(s). Any desired monomer may be selected as the copolymerizable component and they can be formed into a form of a copolymer, a block copolymer or graft copolymer, etc. so as to have a Tg falling within the range of this invention.

The single substance having a Tsp within the range of from 25° C. to 180° C. may include styrene and styrene derivatives such as styrene, o-methylstyrene, m-methylstyrene, p-methylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-phenylstyrene, p-chlorostyrene, 3,4-dichlorostyrene and the like. Styrene monomer is most preferred. As other vinyl monomers, there may be included ethylenically unsaturated monoolefins such as ethylene, propylene, butylene, isobutylene and the like; vinyl halides such as vinyl chloride, vinylidene chloride, vinyl bromide, vinyl fluoride and the like; vinyl esters such as vinyl acetate, vinyl propionate, vinyl benzoate vinyl butyrate and the like; α-methylene aliphatic monocarboxylic acid esters such as methyl acrylate, ethyl acrylate, n-butyl acrylae, isobutyl acrylate, propyl acrylate, n-octyl acrylate, dodecyl acrylate, 2-ethylhexyl acrylate, stearyl acrylate, 2-chloroethyl acrylate, phenyl acrylate, methyl α-chloroacrylate, methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, diethylaminoethyl methacrylate and the like; acrylic acids or methacrylic acid derivatives such as acrylonitrile, methacrylonitrile, acrylamide and the like; vinyl ethers such as vinyl methyl ether, vinyl ethyl ether, vinyl isobutyl ether and the like; vinyl ketones such as vinyl methyl ketone, vinyl hexyl ketone, methyl isopropenyl ketone and the like; N-vinyl compounds such as N-vinylpyrrole, N-vinylcarbazole, N-vinylindole, N-vinylpyrrolidone and the like; vinyl compounds such as vinyl naphthalenes, heterocyclic ring-containing vinyl compounds such as 4-vinylpyridine, 2-vinylpyridine and the like; and so on. These may be used either singly or in the form of a copolymer according to various kinds of combinations.

Further, there are also condensation system compounds as shown below. As the polyester resins, there may be included condensed products between dibasic acids such as terephthalic acid, isophthalic acid, adipic acid, maleic acid, succinic acid, sebacic acid, thioglycolic acid, diglycolic acid and the like and dihydric alcohols such as ethylene glycol, diethylene glycol, 1,4-bis(2-hydroxyethyl)benzene, 1,4-cyclohexane dimethanol, propylene glycol, neopentyl glycol and the like. As the polyamide resins, there may be included ξ-caprolactam, and further condensed products between dibasic acids such as terephthalic acid, isophthalic acid, adipic acid, maleic acid, succinic acid, sebacic acid, thioglycolic acid and acid chlorides thereof and diamino compounds such as ethylenediamine, diaminoethylether, 1,4-diaminobenzene, 1,4-diaminobutane and the like. Further, there may be also employed polyurethane resins, epoxy polymers and the like. In addition, also available are natural resins and synthetic natural resins such as rosin, rosin-modified maleic acid resin, rosin-modified phenol resin, cyclopentadiene polymer, terpene resin and the like.

The polymers as mentioned above may be crosslinked polymers. Such crosslinked polymers may be those polymerizable by self-crosslinking as in the case of prepolymers (the self-crosslinking monomer may also be used in combination with other monomers) or they may be crosslinked polymers prepared by polymerization in the presence of a crosslinking agent.

Any desired known crosslinking agent may be available as such crosslinking agent, provided that it is capable of effecting crosslinking polymerization of the monomer employed. This crosslinking agent may preferably a compound having at least two polymerizable vinyl groups.

Specifically, there may be employed aromatic divinyl compounds such as divinylbenzene, divnylnaphthalene and the like; diethylenically unsaturated carboxylic acid esters such as ethylene glycol dimethacrylate, diethylene glycol dimethacrylate, triethylene glycol trimethacrylate, trimethylolpropane triacrylate, allyl methacrylate, t-butylaminoethyl methacrylate, tetraethyleneglycol dimethacrylate, 1,3-butanediol dimethacrylate and the like; all divinyl compounds such as N,N-divinylaniline, divinyl ether, divinylsulfide, divinylsulfone and others; and compounds having three or more vinyl groups either singly or as a combination of two or more compounds.

Further, as the crosslinking agent in the present invention, it is also possible to use dihydric alcohols such as ethylene glycol, triethylene glycol, 1,2-propylene glycol, 1,3-propylene glycol, 1,4-butanediol, neopentyl glycol, 1,4-butenediol, 1,4-bis (hydroxymethyl)cyclohexane, bisphenol A, hydrogenated bisphenol A, polyoxyethylenated bisphenol A, polyoxypropylenated bisphenol A and the like; dibasic acids such as maleic acid, fumaric acid, mesaconic acid, citraconic acid, itaconic acid, glutaconic acid, phthalic acid, isophthalic acid, terephthalic acid, cyclohexanedicarboxylic acid, succinic acid, adipic acid, sebacic acid, malonic acid, anhydrides thereof or esters thereof with lower alcohols and derivatives thereof; trihydric or higher alcohols such as glycerine, trimethylolpropane, pentaerythritol and the like; tribasic or higher carboxylic acids such as trimellitic acid, pyromellitic acid and the like.

Commercially available products of the resins having Tsp values within the range of from 25° C. to 180° C. are set forth below.

Aliphatic hydrocarbon resins . . . "Adotack, B25-BHT" (25° C.), "Piccopale 100" (100° C.), "Cotack-A" (118° C.).

Aromatic hydrocarbon resins . . . "Harcotack AD 1100 BHT" (97° C.), "Picco 5130" (130° C.), "Piccomer 150" (153° C.).

Pure monomer petroleum hydrocarbon resins . . . "Piccolastic D-125" (125° C.).

Terpene resins . . . "Piccolyte A-115" (115° C.), "Piccolyte C-135" (131° C.), "Piccolyte D-100" (100° C.), "Piccolyte S-55" (55° C.).

Rosin ester . . . "Pentarine A" (104° C.).

Hydrogenated rosin ester . . . "Foral 105" (97° C.).

Polymerized rosin ester . . . "Pentarine K" (177° C.).

Dibasic acid-modified rosin ester . . . "Luizol 821" (141° C.).

Terpene polybasic acid alkyd resin solution . . . "Petolex 7-75 T" (46° C.). . . . All the above produced by Rika Hercules Co.

Ester gum . . . "EG-1000" (100° C.), "PE-K" (175° C.).

Rosin-modified maleic acid resin . . . "Teskid MR G20" (120° C.), "MR M43" (157° C.).

Rosin-modified polyester resin . . . "Tescon RM 1000" (111° C.).

Rosin-modified phenol resin . . . Tespol PRG-FF" (132° C.), "Tespol SPR-L" (155° C.) . . . All the above produced by Tokushima Seiyu Co.

Ester gum . . . "S-80" (75° C.)

Rosin pentaerythritol ester . . . "Pencel KK" (170° C.).

Rosin . . . "HM resin" (120° C.)

Alicyclic saturated hydrocarbon resin . . . "Alcon P-80" (80° C.).

Phenol resin . . . "531" (83° C.).

Terpene phenol resin . . . "803" (152° C.). . . . All the above produced by Arakawa Kagaku Co.

Alicyclic oligomer resins. . . "Quintone 1500" (100° C.), "Quintone 1700" (100° C.). . . . Produced by Nippon Zeon Co., Ltd.

Next, as the mixed substance system having a Tg within the range of this invention as the whole system, there may be employed substance systems having a Tg substantially within the range of from −90° C. to −5° C. obtained by adding a plasticizer such as dibutyl phthalate, N-ethyl-o,p-toluenesulfonamide, butylbenzyl phthalate and tricresyl phosphate to a substance having a Tg exceeding 5° C., including homopolymers, copolymers, graft polymers, block polymers of acrylic or methacrylic acid esters, such as butyl methacrylate (13° C. to 35° C.), methyl acrylate (5° C. to 31° C.) and the like; vinyl halides such as vinyl chloride (81° C.) and the like; vinyl esters such as vinyl acetate (32° C.) and the like; and also epoxy resins, amide resins.

On the other hand, as the mixed substance system having a Tsp within the range of this invention as the whole system, there may be employed a substance system having a Tsp substantially within the range of from 25° C. to 180° C. obtained by adding similarly a plasticizer as mentioned above to a substance having a Tsp exceeding 180° C. as exemplified below (1)

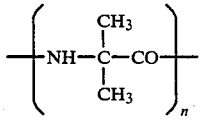

(Tsp = 225° C.)

-continued (2)

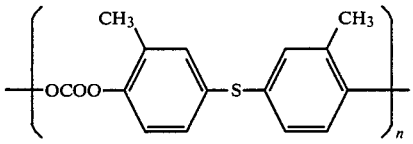

(Tsp = 200~210° C.)

(3)

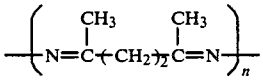

(Tsp = 260° C.)

For preparation of the capsule toner of this invention, various known encapsulation techniques may be available. For example, it is possible to utilize the spray drying method, the interfacial polymerization method, the coacervation method, the in-situ polymerization method, the phase separation method and also the methods as disclosed in U.S. Pat. Nos. 3,338,991; 3,326,848 and 3,502,582.

The outer wall material constituting the microcapsule is not particularly limited, and it is practically preferable to use resins such as epoxy resins, polyamide resins, polyurethane resins, polyurea resins, vinyl resins, urethane-urea resins, epoxy-urea resins, epoxy-urethane resins and others. Particularly, in view of storage stability and rapid reaction time in manufacturing, polyurethane resins, polyurea resins, urethan-urea resins, epoxy-urea resins and epoxy-urethane resins are particularly preferred.

Epoxy resins used may be obtained by reacting epoxy resins or compounds having an epoxy group with a curing agent. The epoxy resins or the compounds having an epoxy group include the following examples, but any one having at least two epoxy groups in the molecule thereof may be used.

(1) Bisphenol A type epoxy resin:

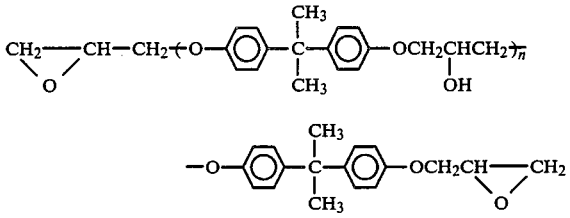

(n is an integer of 0 or more)

Commercial products: "Epikote 801", "Epikote 807", "Epikote 815", "Epikote 819", "Epikote 827", "Epikote 828", "Epikote 834", "Epikote 152", "Epikote 190", "Epikote YX-310", "Epikote DX-255", "Epikote 1045-A-70" (produced by Yuka-Shell Epoxy Co.).

(2) Resorcin type epoxy resin:

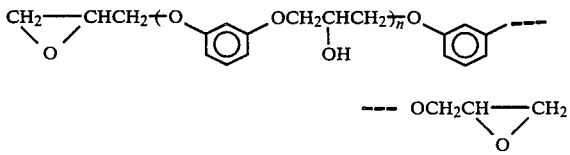

(n is an integer of 0 or more)

(3) Bisphenol F type epoxy resin:

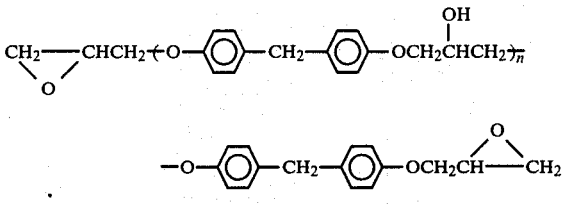

(n is an integer of 0 or more)

(4) Tetrahydroxyphenylmethane type epoxy resin:

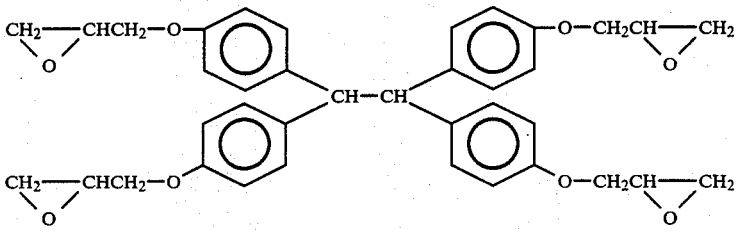

Commercial product; "Epikote 1031", produced by Yuka-Shell Epoxy Co.

(5) Novolac type epoxy epoxy resin:

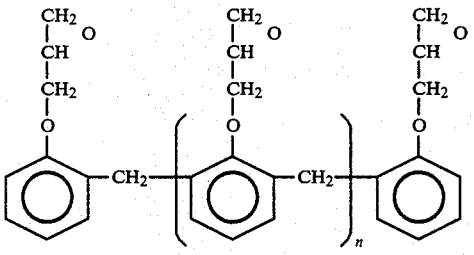

(n is an integer of 0 to 4)

Commercial products: "Epikote 152", "Epikote 154", produced by Yuka-Shell Epoxy Co.

(6) Polyalcohol, polyglycol type epoxy epoxy resin:

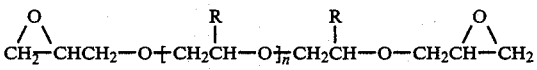

(R represents H, $CH_3$ group or $CH_2CH_3$ group, n is an integer of 0 or more)

(7) Glycerine triether type epoxy resin:

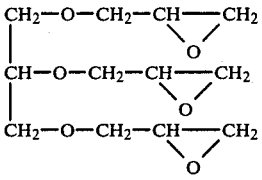

Commercial product: "Epikote 812", produced by Yuka-Shell Epoxy Co.)

(8) Polyolefin type epoxy epoxy resin:

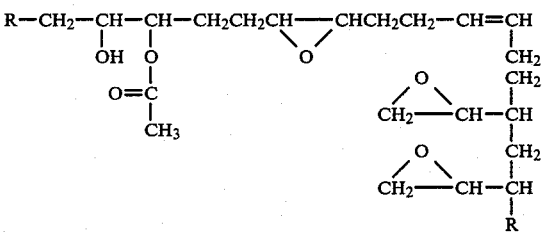

(R represents an alkyl group, an alkenyl group or an aralkyl group).

(9) Epoxidized soybean oil:

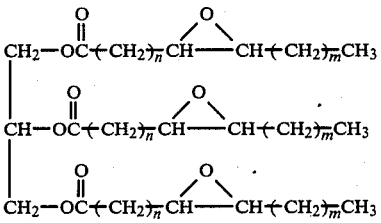

(m is an integer of 0 or more)

(10) Epoxidized linseed oil:

Commercial product: Adekasizer O-180A, produced by Adeka Argas Chemical Co.

(11) Halogenated bisphenol type epoxy resin:

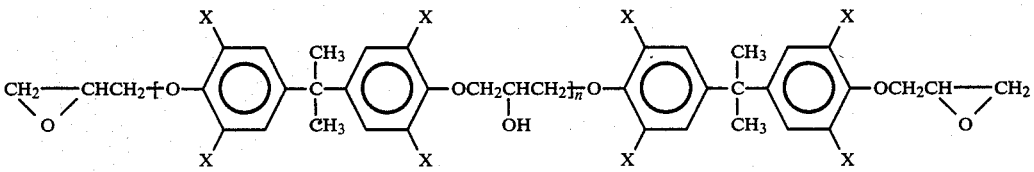

(X represents Cl or Br, n is an integer of 0 or more)

Commercial product: "Epikote 1045-A-70", "Epikote 1050", produced by Yuka-Shell Epoxy Co.

(12) Vinylcyclohexene dioxide:

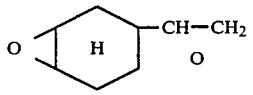

(13) Dicyclopentadiene dioxide:

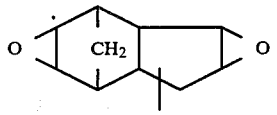

(14) 3,4-Epoxy-6-methylcyclohexylmethyl-3,4-epoxy-6-methylcyclohexane carbonate:

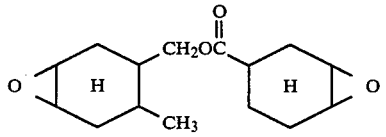

Commercially available bisphenol A type epoxy resins may preferably include "Epikote 807", "Epikote 815", "Epikote 827", "Epikote 190", "Epikote YX-310" and "Epikote DX-255" (produced by Yuka Shell Epoxy Co.). As the above mentioned curing agent, polyamine compounds or modified amine compounds may be used. Typical examples are polyamine compounds such as ethylenediamine, diethylenetriamine, triethylenetriamine, triethylenetetramine, tetraethylenepentamine, hexamethylenediamine, iminobispropylamine, xylylenediamine, phenylenediamine, diaminodiphenylmethane, diaminodiphenylsulphone, isophorondiamine, dicyandiamine, 3,3'-diaminobenzidine, diaminobuthane, diaminodicyclohexylmethane, diaminocyclohexane, 1,5-diamino-2,2-dimethylpentane, 1,3-diamino-2,2-dimethylpropane, 2,4-diaminodiphenylamine, diaminodiphenylether, 4,4-diaminodiphenylsulfide, diaminododecane, diaminofluorene, diaminomethylcyclohexane, diaminonaphtalene, 2.4-diamino-6-phenyltriazine and diaminotoluene; heterocyclic amine or modified amine curing agents such as "Epomate B-001", "Epomate N-001", "Epomate LX-1N" and "Epomate PX-3" (produced by Yuka Shell Epoxy Co.); curing agents such as "Epicure T", "Epicure U", "Epicure 103", "Epicure 121" and "Epicure 138" (produced by Yuka Shell Epoxy Co.)

Other epoxy curing agents include tertiary amines such as triethylamine, benzyldimethylamine and α-methylbenzyldimethylamine; tertiary amine salts; amine complex compounds; tri-fluoro boron complex compounds; imidazoles; acid anhydrides such as phthalic acid anhydride, dodecynyl succinic acid anhydride and chlorendic anhydride.

As the polyamide resin, there may be employed the so-called polyamide resins prepared by the reaction with a carboxylic acid chloride such as sebacic acid chloride, terephthalilc acid chloride, adipic acid chloride and the like with an aliphatic polyamine or an aromatic polyamine as exemplified above as the curing agent for epoxy resin.

Polyurethane resins are obtainable by the reaction of polyisocyanates and polyols, and polyurea resins by the reaction of polyisocyanates and polyamines. Specific examples of polyisocyanates are set forth below.

(1) Hexamethylene diisocyanate:

$OCN(CH_2)_6OCN$

Commercial product: "Sumidur H", produced by Sumitomo-Bayer Urethane Kogyo Co.

(2) Adduct of hexamethylene diisocyanate:

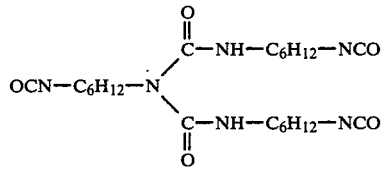

Commerial product: "Sumidur N", produced by Sumitomo-Bayer Urethane Kogyo Co.

(3) Metaphenylene diisocyanate:

Commercial product: "Naphconate" produced by National Aniline Co.

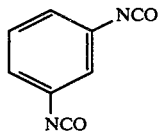

(4) Toluylene diisocyanate:

Mixture of

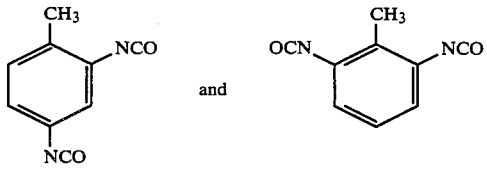

Commercial products:

"Suminate 80", produced by Sumitomo Chemical Company, Limited.; "Hylene TM", produced by Du Pont de Nemours & Co.; "TDI 80/21", "TDI 65/35", produced by Mitsui Nisso Urethane Co.

(5) 2,4-toluylene-diisocyanate:

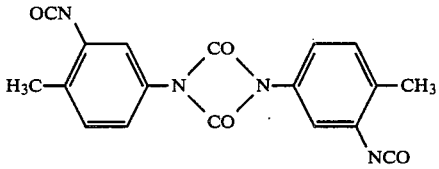

Commercial product: "Sumidur T", produced by Sumitomo-Bayer Urethane Kogyo Co.; "TDI-100", produced by Mitsui Nisso Urethane Co.

(6) Reaction product of toluylene isocyanate and trimethylolpropane:

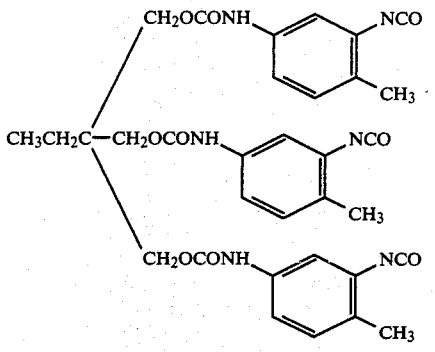

Commercial products: "Sumidur T", produced by Sumitomo-Bayer Urethane Kogyo Co.; "Coronate L", produced by Nippon Polyurethane Kogyo Co.

(7) 3,3'-dimethyl-diphenyl-4,4'-diisocyanate:

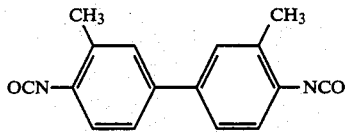

Commercial product: "Hylene H", produced by Du Pont de Nemours & Co.; "Suminate BT", produced by Sumitomo Chemical Company, Limited.

(8) Diphenylmethane-4,4'-diisocyanate:

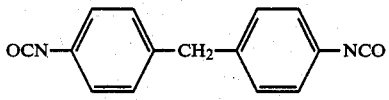

Commercial product: "Millionate MT", produced by Nippon Polyurethane Kogyo Co.; "ISONATE 125M", produced by Kasei Upjohn Co.; "Suminate M", produced by Sumitomo Chemical Company, Limited.

(9) 3,3'-Dimethyl-diphenylmethane-4,4'-diisocyanate:

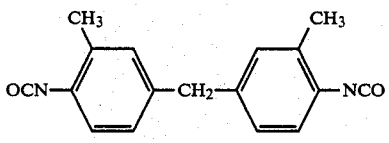

Commercial product: "Hylene DMM", produced by Du Pont de Nemours & Co.

(10) Triphenylmethane-triisocyanate:

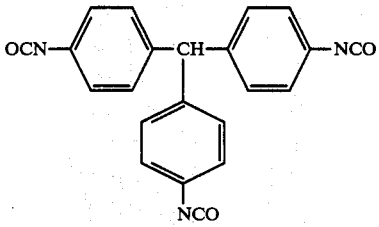

Commercial product: "Desmodur R", produced by Sumitomo-Bayer Urethane Kogyo Co.

(11) Polymethylenephenyl isocyanate:

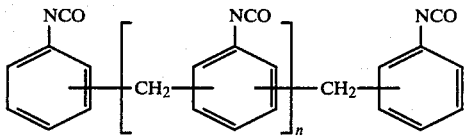

Commercial product: "Sumidur 44V-10", produced by Sumitomo-Bayer Urethane Kogyo Co.; "Millionate MR", produced by Nippon Polyurethane Kogyo Co.; "PAPI 135", "PAPI 20", produced by Kasei Upjohn Co.

(12) Naphthalene-1,5-diisocyanate:

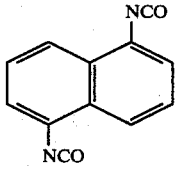

Commercial product: "Desmodur 15", produced by Sumitomo-Bayer Urethane Kogyo Co.;

Commercial product: "Desmodule 15", produced by Sumitomo-Bayer Urethane Kogyo Co.

Specific examples of polyols and polyamines which can react with the polyisocyanates as described above to give polyurethane resins polyurea resins or polyurea-urethane resins are shown below.

(1) Polyols

Ethylene glycol, diethylene glycol, triethylene glycol, propylene glycol, butylene glycol, hexamethylene glycol glycerine, trimethylolpropane, trimethylolethane, 1,2,6hexanetriol, pentaerythritol, glycerine monomethylether, glycerine monoethylether, polyvinylalcohol, polyethylene glycole, polypropylene glycol, etc.

(2) Polyamines

Polyamine compounds, modified amine curing agents for the above-mentioned epoxy resins, such as ethylenediamine, hexamethylenediamine diethylenetriamine, iminobispropylamine, phenylenediamine, xylenediamine, triethyltetramine and others.

Epoxy-urea resins are obtainable by reacting polyamine compounds with a mixture of the polyisocyanate compounds used for preparing the aforementioned polyurea resins and epoxy resins or other compounds having an epoxy group for epoxyresins.

Epoxy-urethane resins are obtainable by reacting polyhydroxy compounds and polyamine compounds or curing agents for epoxy resins other than polyamine compoumds with a mixture of the polyisocyanate compounds used for preparing the aforementioned polyurea resins and epoxy resins or other compounds having an epoxy group for epoxy resins. Also, compounds having a hydroxy group and an amino group such as ethanolamine, buthanolamine and diethanolamine may be used for producing epoxy-urethane reisns.

Further, vinyl polymerizable monomers for obtaining vinyl resins may include styrenes such as styrene, p-chlorostyrene, α-methylstyrene, t-butylstyrene and the like; α-methylene aliphatic monocarboxylates such as methyl acrylate, ethyl acrylate, n-propyl acrylate, stearyl acrylate, 2-ethylhexyl acrylate, phenyl acrylate, methyl methacrylate, ethyl methacrylate, n-butyl methacrylate, 2-ethylhexyl methacrylate, phenyl methacrylate and the like; vinyl nitriles such as acrylonitrile, methacrylonitrile and the like; vinyl ethers such as vinyl methyl ether, vinyl isobutyl ether and the like; vinyl pyridines such as 2-vinylpyridine, 4-vinylpyridine and the like; N-vinylcyclic compounds such as N-vinylpyrrolidone and the like; vinyl ketones such as vinyl methyl ketone, vinyl ethyl ketone, vinyl isopropenyl ketone and the like, unsaturated hydrocarbons such as ethylene, propylene, isobutylene, butadiene, isoprene and the like; halo-containing unsaturated hydrocarbons such as chloroprene and the like; and other mono-functional vinyl monomers. These monomers can be used either singly or in combination.

In addition to the mono-functional monomers, polyfunctional monomers may be also available, which may include polyhydric alcohol methacrylates such as ethylene glycol dimethacrylate, diethylene glycol dimethacrylate, triethylene glycol dimethacrylate, tetraethylene glycol dimethacrylate, neopentylglycol dimethacrylate, dipropylene glycol dimethacrylate, trimethylolpropane trimethacrylate, trimethylolethane trimethacrylate, pentaerythritol tetramethacrylate and the like; polyhydric alcohol acrylates such as diethylene glycol diacrylate, triethylene glycol diacrylate, tetraethylene glycol diacrylate, neopentylglycol diacrylate, trimethylolpropane triacrylate, trimethylolethane triacrylate, pentaerythritol tetraacrylate and the .like; poly-functional vinylbenzenes such as divinylbenzene and the like; and others. They can be used either singly or in combination. Further, these poly-functional monomers can be used in combination with the mono-functional monomers as already described.

The microcapsule type toner of the present invention is formed by using a suitable combination of the core material and the wall material, and a colorant is generally contained in the core material or further in the wall material. Also, when the toner of the present invention is made a magnetic toner, fine powder of a magnetic material may be contained in place of or together with the colorant. Other than these materials, various additives may also be contained, if necessary.

As colorants, there may be employed carbon black, Nigrosine dye (C.I. No. 50415B), Aniline Blue (C.I. No. 50405), Calcooil Blue (C.I. No. azoic Blue 3), Chrome Yellow (C.I. No. 14090), Ultramarine Blue (C.I. No. 77103), Du Pont Oil Red (C.I. No. 26105), Quinoline Yellow (C.I. No. 47005), Methylene Blue Chloride (C.I. No. 52015), Phthalocyanine Blue (C.I. No. 74160), Malachite Green Oxalate (C.I. No. 42000), Lamp Black (C.I. No. 77266), Rose Bengal (C.I. No. 45435), mixtures thereof and others. These colorants are required to be incorporated at proportions enough to form visible images of sufficient density, generally in an amount of 1 to 20 parts by weight based on 100 parts by weight of toner.

As the aforesaid magnetic materials, there may be employed metals or alloys exhibiting strong magnetic property such as iron, cobalt, nickel, etc. or compounds containing these elements, typically ferrite, magnetite, or alloys which contain no strong magnetic element but exhibits strong magnetic property when subjected to suitable heat treatmeht, such as alloys of the type called as Whisler alloys containing manganese and copper (e.g. manganese-copper-aluminum, manganese-copper-tin, etc.), chromium dioxide, etc. These magnetic materials may be dispersed uniformly in the fluid core material in the form of micropowder with average particle sizes of 0.1 to 1 micron. The content of such magnetic materials may range from 20 to 70 parts by weight, preferably 40 to 70 parts by weight per 100 parts by weight of the toner.

When fine powder of a magnetic material is contained to form a magnetic toner, it can be treated similarly as in the case of a colorant. However, since such fine powder of a magnetic material is low in affinity for organic materials such as core materials, monomers, etc., it is recommendable to use the fine powder of a magnetic material together with a coupling agent such as titanium coupling agent, silane coupling agent, lecithin, etc. or treat the powder with the coupling agent before use.

The microcapsule type toner of this invention may have a particle size, which is not particularly limited, but its mean particle size is generally 5 to 50μ, preferably 5 to 30μ. The thickness of the outer wall and the particle size of the core material may be similar to those of the microcapsule toner of the prior art and preferably ranges from 0.05 to 3.0μ. more preferably from 0.2 to 2.0μ.

The microcapsule type toner of the invention, when it contains fine powder of a magnetic material, can be used solely as a developer. On the other hand, when containing no fine powder of a magnetic material, it can be mixed with a carrier to prepare a two component developer.

Carriers are not particularly limited, and iron powder, glass beads or these materials coated with resin may be used at a mixing ratio of 0.5 to 10 wt. %, preferably 1 to 5 wt. % based on the toner. The carrier employed may have particle sizes of 25 to 1000μ, preferably 30 to 500μ.

The present invention is described below by referring to the Examples.

EXAMPLES 1

(Example according to the in situ polymerization method)

After 70 g of 2-ethylhexyl methacrylate (Tg of homopolymer = −10° C.) and 30 g of an ester gum "EG-1000" (Tsp = 100° C., produced by Tokushima Seiyu Co.) as the core materials, 70 g of Epikote 815 (produced by Yuka Shell Epoxy Co.) as the outer wall material (I) and 10 g of Epomate B-001 (produced by Yuka Shell Epoxy Co.) as the outer wall material (II) were homogeneously mixed in a sand grinder, 3.5 g of lauroyl peroxide (LPO) as the radical polymerization initiator for 2-ethylhexyl methacrylate, 170 g of tri-iron tetraoxide BL-100 (produced by Titanium Kogyo Co.) and 0.9 g of lecithin as the promoter for dispersing fluidization of the magnetic powder in the above mixture were added, followed further by mixing and dispersing homogeneously by means of a sand grinder for about 30 minutes. Then, the above homogeneously mixed dispersion was suspended into 3 liters of an aqueous solution containing 20 g of colloidal tricalcium phosphate and 0.2 g of sodium dodecylbenzene sulfonate as suspension stabilizers by means of a homojetter (produced by Tokushukika Kogyo Co.) by controlling the number of revolution of the homojetter so as to make the mean size of the dispersion 15μ. The suspension was heated to 75° C. and maintained thereat for 8 hours to polymerize 2-ethylhexyl methacrylate with LPO simultaneously with formation of the epoxy resin film formed through the reaction of "Epikoat 815" and "Epomate B-001" on the dispersed droplet surface. After the reaction, dispersion stabilizers were removed by decomposition with hydrochloric acid, and the product was filtered and washed with water, followed by drying, to give a microcapsule type magnetic toner comprising core materials of poly-2-ethylhexyl methacrylate and the ester gum "EG-1000" and an outer wall of an epoxy resin. This toner is designated as Toner 1.

EXAMPLE 2

(Example according to the interfacial polymerization method)

As the core materials, 60 g of dodecyl acrylate (Tg of homopolymer = −3° C.) and 40 g of an aliphatic hydrocarbon resin "Adtack, B 25-BHT) (Tsp=25° C., produced by Rika Hercules Co.) and, as the outer wall (I), 100 g of a polymethylenephenyl isocyanate "Millionate MR" (produced by Nippon Polyurethane Kogyo Co.) were added and homogeneously mixed by a sand grinder. Then, 3.0 g of lauroyl peroxide (LPO) as the radical polymerization initiator for dodecyl acrylate and 200 g of tri-iron tetraoxide BL-120 (produced by Titanium Kogyo Co.) as the magnetic powder for magnetic toner were added to the mixture, followed by homogeneous mixing and dispersing by a sand grinder for about 30 minutes. As the next step, the above homogeneously mixed dispersion was suspended into 3 liters of an aqueous solution containing 20 g of colloidal tricalcium phosphate and 0.2 g of sodium dodecylbenzene sulfonate as dispersion stabilizers by means of a homojetter (produced by Tokushukika Kogyo Co.) by controlling the number of revolution of the homojetter so as to make the mean size of the dispersion 15μ. Into the resultant dispersion was added dropwise 20 g o xylylenediamine as the outer wall material (II), and the dispersion was stirred for about 3 hours to permit "Millionate MR" to react with xylylenediamine at the dispersed droplet interface to form the outer wall of a polyurea on the dispersed droplet surface. Then, the dispersion was heated to 75° C. and maintained thereat for 8 hours to effect polymerization of dodecylacrylate with LPO. After the reaction, dispersion stabilizers were removed by decomposition with hydrochloric acid, and the product was filtered and washed with water, followed by drying, to give a microcapsule type magnetic toner comprising core materials of polydodecyl acrylate and "Adtack B 25-BHT" and an outer wall of an polyurea resin. This toner is designated as Toner 2.

EXAMPLE 3

(Example according to the coacervation method and the spray drying method)

As the core materials, 13 g of methyl acrylate (Tg of homopolymer=5° C. to 31° C.), 2 g of an emulsifier of dibutyl phthalate and 5 g of polymerized rosin ester "Pentaline K" (Tsp=177° C.) (produced by Rika Hercules Co.) were homogeneously mixed (Tg of the polymethyl acrylate/dibutyl phthalate system = −15° C. to 7° C.), and 1 g of carbon black and benzoyl peroxide (BPO) as the radical polymerization initiator for methyl acrylate were added thereto, followed by homogeneous mixing and dispersion by a sand grinder for 30 minutes. Separately, 15 g of urea and 40 g of an aqueous 37% formaldehyde solution were mixed, adjusted to pH 8 with an aqueous 10 methanolamine solution and then stirred at 70° C. for about 3 hours to obtain an initial condensation product of urea-formaldehyde. Then, the above homogeneously mixed dispersion was suspended into 250 cc of an aqueous solution containing 30 g of the initial condensation product by means of a homojetter by controlling the number of revolution of the homojetter so as to make the mean size of the dispersion 15μ. While stirring the dispersion, citric acid was gradually added to adjust the pH to 5, followed by stirring at 50° C. for 2 hours. Further, the pH was lowered to 3 with citric acid and the mixture was further maintained at 50° C. for 5 hours to form an outer wall of urea-formaldehyde condensation product on the dispersed droplet surface. Then, the temperature was raised to 90° C. and maintained thereat for 8 hours to polymerize methyl acrylate. The thus prepared capsule particles were washed with water and filtered. As the next step, the capsules were mixed with an emulsion of a styrene-acrylic copolymer separately prepared containing 20 parts of the resin per 100 parts of capsules and the mixture was spray dried by means of a spray drier to provide the outer wall of the styrene-acrylic copolymer on the outside of the above capsules. Thus, a microcapsule type toner having the outermost wall of a styrene-acrylic copolymer and the core materials of polymethyl acrylate/dibutyl phthalate, "Pentarine K" as core materials was obtained. This toner is designated as "Toner 3".

EXAMPLES 4 TO 6

Example 1 was repeated except for substituting the core materials, outer wall materials and the additives for the materials shown in Table 1 to obtain microcapsule type toners. The toners obtained are designated as "Toner 4", "Toner 5" and "Toner 6", respectively.

EXAMPLES 7 TO 9

Example 2 was repeated except for substituting the core materials, outer wall materials and the additives for the materials shown in Table 2 to obtain microcapsule type toners. The toners obtained are designated as "Toner 7", "Toner 8" and "Toner 9", respectively.

EXAMPLE 10

Example 3 was repeated except for substituting the core materials, outer wall materials and the additives for the materials shown in Table 3 to obtain a microcapsule type toner. The toner obtained is designated as "Toner 10".

EXAMPLES 11 TO 12

Example 2 was repeated except for substituting the core materials, outer wall materials and the additives for the materials shown in Table 4 to obtain microcapsule type toners. The toners obtained are designated as "Toner 11" to "Toner 21", respectively.

TABLE 1

| Core material | Outer wall material | Additive |
|---|---|---|
| Example 4, Toner 4: | | |
| 1-Chloro-1-butenylene (60 parts) (Tg = −20° C. to 40° C.) + | (I) Adipic acid chloride + (II) Triethylenediamine (polyamide) | Tri-iron tetraoxide + Lecithin |

TABLE 1-continued

| Core material | Outer wall material | Additive |
|---|---|---|
| Rosin ester "Pentarine A" (40 parts) (Tsp = 104° C., produced by Rika Hercules Co.) | | |
| Example 5, Toner 5: | | |
| 4-Octyloxymethylstyrene (60 parts) (Tg = −42° C.) + Hydrogenated rosin ester "Foral 105" (40 parts) (Tsp = 97° C., produced by Rika Hercules Co.) | Styrene LPO (vinyl) | Carbon black |
| Example 6, Toner 6: | | |
| Polyisobutyl acrylate (70 parts) (Tg = −24° C.) + Terpene resin "Piccolyte S-55" (30 parts) (Tsp = 55° C., produced by Rika Hercules Co.) | Ethyleneglycol dimethacrylate/styrene (2:1) LPO (vinyl copolymer) | Tri-iron tetraoxide + Lecithin |

TABLE 2

| Core material | Outer wall material | Additive |
|---|---|---|
| Example 7, Toner 7: | | |
| 2-Ethylhexyl methacrylate (80 parts) (Tg = −10° C.) + Ester gum "S-80" (20 parts) (Tsp = 75° C., produced by Arakawa Kagaku Co.) | (I) Epikote 819 (produced by Yuka Shell Epoxy Co.) + (II) Epikote LX-1N (produced by Yuka Shell Epoxy Co.) (epoxy) | Tri-iron tetraoxide + Lecithin |
| Example 8, Toner 8: | | |
| Dodecyl methacrylate (70 parts) (Tg = −65° C.) + Rosin-modified maleic acid resin "Teskid MRG 20" (30 parts) (Tsp = 120° C., produced by Tokushima Seiyu Co.) | (I) Terephthalic acid chloride + (II) Diethylenetriamine (polyamide) | Carbon black |
| Example 9, Toner 9: | | |
| Polyoxymethyl styrene (70 parts) (Tg = −42° C.) + Alicyclic saturated hydrocarbon resin "Alcon P-80" (30 parts) (Tsp = 80° C.) | (I) Hexamethylene diisocyanatene "Coronate HL" (produced by Nippon Polyurethane Kogyo Co.) (urethane) | Tri-iron tetraoxide + Lecithin |

TABLE 3

| Core material | Outermost wall material | Additive |
|---|---|---|
| Example 10, Toner 10: | | |
| 4-Octyloxystyrene (90 parts) (Tg = −42° C.) + Alicyclic oligomer resin "Quintone 1500" (10 parts) (Tsp = 100° C., produced by Nippon Zeon Co.) | (I) "Epikote 871" (produced by Yuka Shell Epoxy Co.) + (II) Epicure T (produced by Yuka Shell Epoxy Co.) | Tri-iron tetraoxide + Lecithin |

TABLE 4

| Core material | Outer wall material (I) | Outer wall material (II) | Additive |
|---|---|---|---|
| Example 11, Toner 11: | | | |
| Butyl acrylate (Tg: −54° C.) 8 g Lauroyl peroxide 2 g "Piccolastic D-125" (Tsp: 125° C.) (produced by Rika | "Sumidur 44V-10" (produced by Sumitomo-Bayer Urethane Kogyo Co.) 28 g "Epikote 819" (produced by Yuka-Shell Epoxy Co.) 12 g | Xylylene diamine 20 g | Tri-iron tetraoxide "BL-520" (produced by Titan Kogyo KK) 100 g Lecithin 0.2 g |

TABLE 4-continued

| Core material | Outer wall material (I) | Outer wall material (II) | Additive |
|---|---|---|---|
| Hercules Co.) 12 g | | | |
| Example 12, Toner 12: | | | |
| Ethyl acrylate (Tg: −24° C.) 54 g Lauroyl peroxide 2 g "Pentarine A" (Tsp: 104° C.) (produced by Rika Hercules Co.) 6 g | "Sumidur 44V-10" (produced by Sumitomo-Bayer Urethane Kogyo Co.) 24 g "Epikote 819" (produced by Yuka-Shell Epoxy Co.) 16 g | Xylylene diamine 20 g | Tri-iron tetraoxide "BL-520" (produced by Titan Kogyo KK) 100 g Lecithin 0.2 g |
| Example 13, Toner 13: | | | |
| 2-Ethylhexyl acrylate (Tg: −50° C.) 40 g Lauroyl peroxide 2 g Ester gum "EG-1000" (Tsp: 100° C.) (produced by Tokushima Seiyu Co.) 10 g | "Sumidur 44V-10" (produced by Sumitomo-Bayer Urethane Kogyo Co.) 30 g "Epikote 152" (produced by Yuka-Shell Epoxy Co.) 20 g | Hexamethylene diamine 20 g | Tri-iron tetraoxide "BL-120" (produced by Titan Kogyo KK) 100 g Lecithin 0.2 g |
| Example 14, Toner 14: | | | |
| Butyl acrylate (Tg: −54° C.) 42 g Lauroyl peroxide 2 g "Teskid MRG-20" (Tsp: 120° C.) (produced by Tokushima Seiyu Co.) 18 g | "Sumidur 44V-10" (produced by Sumitomo-Bayer Urethane Kogyo Co.) 20 g "Epikote 819" (produced by Yuka-Shell Epoxy Co.) 20 g | Diaminocyclohexane 20 g | Tri-iron tetraoxide "BL-520" (produced by Titan Kogyo KK) 100 g Lecithin 0.2 g |
| Example 15, Toner 15: | | | |
| Dodecyl methacrylate (Tg: −65° C.) 48 g Azobisisobutyronitrile 2 g "Tespol SPR-L" (Tsp: 155° C.) (produced by Tokushima Seiyu Co.) 12 g | "Sumidur 44V-10" (produced by Sumitomo-Bayer Urethane Kogyo Co.) 24 g "Epikote 190" (produced by Yuka-Shell Epoxy Co.) 16 g | Xylylene diamine 20 g | Tri-iron tetraoxide "BL-520" (produced by Titan Kogyo KK) 100 g Lecithin 0.2 g |
| Example 16, Toner 16: | | | |
| Dodecyl methacrylate (Tg: −65° C.) 48 g Azobisisobutyronitrile 2 g Ester gum "EG-1000) (Tsp: 100° C.) produced by Tokushima Seiyu Co.) 12 g | "Sumidur 44V-10" (produced by Sumitomo-Bayer Urethane Kogyo Co.) 28 g "Epikote 819" (produced by Yuka-Shell Epoxy Co.) 12 g | Xylylene diamine 20 g | Tri-iron tetraoxide "BL-520" (produced by Titan Kogyo KK) 100 g Lecithin 0.2 g |
| Example 17, Toner 17: | | | |
| Dodecyl methacrylate (Tg: −65° C.) 48 g Azobisisobutyronitrile 2 g Ester gum "EG-1000) (Tsp: 100° C.) produced by Tokushima Seiyu Co.) 12 g | "Sumidur L" (produced by Sumitomo-Bayer Urethane Kogyo Co.) 28 g Epikote 819 (produced by Yuka-Shell Epoxy Co.) 12 g | Polyvinyl alcohol 10 g | Tri-iron tetraoxide "BL-520" (produced by Titan Kogyo KK) 100 g Lecithin 0.3 g |
| Example 18, Toner 18: | | | |
| Dodecyl methacrylate (Tg: −65° C.) 48 g Azobisisobutyronitrile 2 g Ester gum "EG-1000) (Tsp: 100° C.) produced by Tokushima Seiyu Co.) 12 g | "Millionate MR" (produced by Nippon Poly Urethane Kogyo Co.) 28 g Epikote 819 (produced by Yuka-Shell Epoxy Co.) 12 g | Butylene glycol 20 g | Tri-iron tetraoxide "BL-520" (produced by Titan Kogyo KK) 100 g Lecithin 0.3 g |
| Example 19, Toner 19: | | | |

TABLE 4-continued

| Core material | Outer wall material (I) | Outer wall material (II) | Additive |
|---|---|---|---|
| Dodecyl methacrylate (Tg: −65° C.) 48 g<br>Azobisisobutyronitrile 2 g<br>Ester gum "EG-1000) (Tsp: 100° C.) produced by Tokushima Seiyu Co.) 12 g | "Millionate MR" (produced by Nippon Poly Urethane Kogyo Co.) 28 g<br>Epikote 819 (produced by Yuka-Shell Epoxy Co.) 12 g | Neopentyl glycol 15 g<br>Xylylene diamine 10 g | Tri-iron tetraoxide "BL-520" (produced by Titan Kogyo KK) 100 g<br>Lecithin 0.3 g |
| Example 20, Toner 20: | | | |
| 2-Ethylhexyl acrylate (Tg: −50° C.) 54 g<br>Azobisisobutyronitrile 2 g<br>Ester gum "EG-1000" (Tsp: 100° C.) (produced by Tokushima Seiyu Co.) 6 g | "Sumidur 44V-10" (produced by Sumitomo-Bayer Urethane Kogyo Co.) 28 g<br>"Epikote 819" (produced by Yuka-Shell Epoxy Co.) 12 g | Polyvinyl alcohol 10 g<br>Xylylene diamine 15 g | Tri-iron tetraoxide "BL-520" (produced by Titan Kogyo KK) 100 g<br>Lecithin 0.3 g |
| Example 21, Toner 21: | | | |
| Dodecyl methacrylate (Tg: −65° C.) 40 g<br>Azobisisobutyronitrile 2 g<br>"Quintone 1700" (Tsp: 100° C.) (produced by Nippon Zeon Co.) 10 g | "Sumidur 44V-10" (produced by Sumitomo-Bayer Urethane Kogyo Co.) 35 g<br>"Epikote 819" (produced by Yuka-Shell Epoxy Co.) 15 g | Diethanol amine 20 g | Tri-iron tetraoxide "BL-520" (produced by Titan Kogyo KK) 100 g<br>Lecithin 0.3 g |

COMPARATIVE EXAMPLE 1

In Example 1, only 2-ethylhexyl methacrylate of the core material was changed to isopropyl methacrylate (Tg of homopolymer=27° C. to 85° C.) to obtain "Comparative toner 1".

COMPARATIVE EXAMPLE 2

In Example 2, only "Adtack B 25-BHT" of the core material was changed to a Terpene resin "Picolite S-10" (Tsp=10° C., produced by Rika Hercules Co.) to obtain "Comparative toner 2".

COMPARATIVE EXAMPLE 3

In Example 3, only methyl acrylate of the core material was changed to hexadecyl acrylate (Tg of homopolymer=5° C.) to obtain "Comparative toner 3".

COMPARATIVE EXAMPLE 4

In Example 4, only "Pentarine A" was changed to an aliphatic unsaturated hydrocarbn "Adtack B10-BHT" (Tsp=10° C., produced by Rika Hercules Co.) to obtain "Comparative toner 4".

COMPARATIVE EXAMPLE 5

In Example 5, 4-octyloxymethylstyrene of the core material was changed to pentenylene (Tg of homopolymer=−90° C. to −114° C.) and "Foral 105" to a pure monomer petroleum hydrocarbon "A - 5" (Tsp=5° C., produced by Rika Hercules Co.) to obtain "Comparative toner 5".

COMPARATIVE EXAMPLE 6

In Example 5, polyisobutyl acrylate of the core material was changed to polyhexadecyl methacrylate (Tg=15° C.) and "Picolite S-55" to an aromatic hydrocarbon "Picomer 10" (Tsp=15° C., produced by Rika Hercules Co.) to obtain "Comparative toner 6".

COMPARATIVE EXAMPLE 7

In Example 7, only 2-ethylhexyl methacrylate was changed to octadecyl methacrylate (Tg of homopolymer=−100° C.) to obtain "Comparative toner 7".

COMPARATIVE EXAMPLE 8

In Example 8, only dodecyl methacrylate was changed to isodecyl acrylate (Tg of homopolymer=40° C.) to obtain "Comparative toner 8".

COMPARATIVE EXAMPLE 9

In Example 9, polyoxymethylstyrene was changed to polyoctyloxystyrene (Tg of homopolymer=13° C.) and "Alkon P-80" to a petroleum feedstock of polymerized distillate of naphtha "Picoper AP-10" (Tsp=11° C., produced by Rika Hercules Co.) to obtain "Comparative toner 9".

COMPARATIVE EXAMPLE 10

In Example 10, only 4-octyloxymethylstyrene was changed to 4-octadecylstyrene (Tg of homopolymer=32° C.) to obtain "Comparative toner 10".

[Fixing test of toner]

Using each of Toner 1 through Toner 21 and Comparative toner 1 through Comparative toner 10 as the developer, an electrostatic charge was developed in an electrophotographic copying machine "U-Bix T" (produced by Konishiroku Photo Industry, Co.) which was modified to a pressure fixing type, and the toner image was transferred to a fixing member comprising a plain paper, and fixing was performed by a pressure fixer having a line pressure of 15 Kg/cm.

On the "solid black" portion of the visible image thus obtained was adhered a commercially available tacky tape under a pressure of 5 Kg/cm$^2$ and the tacky tape was peeled off by means of the tester trially made as shown in FIG. 1 at a constant speed in the direction of the paper surface. In FIG. 1, numeral 1 is a tape for fixing the paper to be fixed, 2 is a member for fixing, 3 is a tacky tape and 4 is a step motor.

After peeled off as described above, the reflection density $I_2$ at the peeled portion was measured by a densitometer (PDA-65, produced by Konishiroku Photo Industry Co.) and the ratio to the reflection density $I_1$ before peel-off, $I_2/I_1$, was measured as a measure of the pressure fixing characteristic. Results are shown in Table 4. As apparently seen from the Table, Toner 1 through Toner 21 have higher values than Comparative toner 1 through Compartive toner 10, thus indicating superiority of Toner 1 through Toner 21 according to the present invention.

TABLE 4

| Toner No. | $I_2/I_1$ | Toner No. | $I_2/I_1$ | Comparative toner No. | $I_2/I_1$ |
|---|---|---|---|---|---|
| 1 | 0.71 | 11 | 0.71 | 1 | 0.48 |
| 2 | 0.73 | 12 | 0.70 | 2 | 0.53 |
| 3 | 0.68 | 13 | 0.68 | 3 | 0.47 |
| 4 | 0.70 | 14 | 0.71 | 4 | 0.59 |
| 5 | 0.68 | 15 | 0.73 | 5 | 0.45 |
| 6 | 0.72 | 16 | 0.75 | 6 | 0.45 |
| 7 | 0.78 | 17 | 0.74 | 7 | 0.46 |
| 8 | 0.83 | 18 | 0.75 | 8 | 0.43 |
| 9 | 0.75 | 19 | 0.71 | 9 | 0.47 |
| 10 | 0.70 | 20 | 0.74 | 10 | 0.46 |
| | | 21 | 0.70 | | |

As can clearly be seen from the above Examples, this invention can provide microcapsule type toners excellent in pressure fixing characteristic.

We claim:

1. A pressure fixable microcapsule type toner comprising a core material and an outer wall covering over said core material, said core material comprising a combination of (i) a substance (a) having a glass transition point within the range of from −90° C. to 5° C. or a mixed substance system (a') having a glass transition point as the whole system within the range of from −90° C. to 5° C. with (ii) a substance (b) having a softening point within the range of from 25° C. to 180° C. or a mixed substance system (b') having a softening point as the whole system within the range of from 25° C. to 180° C.; said substance (i) being in an amount of 60 to 90% by weight of said core material; and said outer wall comprising a polymeric covering resin.

2. The pressure fixable microcapsule type toner according to claim 1, wherein said substance (a) is selected from the group consisting of polymers of dienes, polymers of alkenes, polymers of acrylates, polymers of methacrylates, polymers of vinyl ethers, polymers of styrene derivatives, polymers of urethanes and polymers of siloxanes; a rubber; or a copolymer of any of these monomers together with or without other monomer(s).

3. The pressure fixable microcapsule type toner according to claim 2, wherein said substance (a) is selected from the group consisting of polymer of 1-chloro-1-butenylene, isoprene or 1-butenylene; polymer of butene, isobutylene, isohexylethylene or propylene; polymer of butyl acrylate, sec-butyl acrylate, iso-butyl acrylate, ethyl acrylate, 2-ethylhexyl acrylate, heptyl acrylate, 2,2,3,3,5,5,5-heptafluoro-4-oxapentyl acrylate, hexyl acrylate or dodecyl acrylate; polymer of decyl methacrylate, dodecyl methacrylate, hexyl methacrylate or 2-ethylhexyl methacrylate; polymer of butyl vinyl ether, 2-ethylhexyl vinyl ether or methyl vinyl ether; polymer of 4-(2-butoxy-ethoxy)methylstyrene, 4-decylstyrene or 4-octyloxymethylstyrene; polymer of oxy-2-butenyleneoxycarbonyl iminohexamethyleneiminocarbonyl, oxy-2-butenyleneoxycarbonyliminohexamethyleneiminocarbonyl or oxy-2,2-diethyltrimethyleneoxycarbonylimino-4-methyl-1,3-phenyleneiminocarbonyl; polymer of oxymethyl-3,3,3-trifluoropropylsilylene or oxymethylphenylsilylene; styrene-butadiene rubber, acrylonitrile-butadiene rubber or ethylene-propylene rubber; or a copolymer of any of these monomers together with or without other monomers.

4. The pressure fixable microcapsule type toner according to claim 1, wherein said substance (b) is selected from the group consisting of styrene, styrene derivatives, ethylenically unsaturated monoolefins, vinyl halides, vinyl esters, α-methylene aliphatic monocarboxylic acid esters, acrylic acids or methacrylic acid derivatives, vinyl ethers, vinyl ketones, N-vinyl compounds, vinyl naphthalenes, heterocyclic ring-containing vinyl compounds, and a copolymer of any of these monomers; a polyester resin; or a polyamide resin.

5. The pressure fixable microcapsule type toner according to claim 4, wherein said substance (b) is selected from the group consisting of styrene, o-methylstyrene, m-methylstyrene, p-methylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-phenylstyrene, p-chlorostyrene, 3,4-dichlorostyrene, ethylene, propylene, butylene, isobutylene, vinyl chloride, vinylidene chloride, vinyl bromide, vinyl fluoride, vinyl acetate, vinyl propionate, vinyl benzoate, vinyl butyrate, methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, phenyl acrylate, methyl α-chloroacrylate, methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, diethylaminoethyl methacrylate, acrylonitrile, methacrylonitrile, acrylamide, vinyl methyl ether, vinyl ethyl ether, vinyl isobutyl ether, vinyl methyl ketone, vinyl hexyl ketone, methyl isopropenyl ketone, N-vinylpyrrole, N-vinylcarbazole, N-vinylindole, N-vinylpyrrolidone, 4-vinylpyridine, 2-vinylpyridine, and a copolymer of any of these monomers.

6. The pressure fixable microcapsule type toner according to claim 1, wherein said mixed substance system (a') is a mixture of a plasticizer selected from the group consisting of dibutyl phthalate, N-ethyl-o,p-toluenesulfonamide, butylbenzyl phthalate and tricresyl phosphate, and a substance having a glass transition point exceeding 5° C.

7. The pressure fixable microcapsule type toner according to claim 1, wherein said mixed substance system (b') is a mixture of a plasticizer selected from the group consisting of dibutyl phthalate, N-ethyl-o,p-toluenesulfonamide, butylbenzyl phthalate and tricresyl phosphate, and a substance having a glass transition point exceeding 180° C.

8. The pressure fixable microcapsule type toner according to claim 1, wherein said substance (a) or (a') has a glass transition point ranging from −80° C. to −10° C. and said substance (b) or (b') has a softening point ranging from 35° C. to 170° C.

9. The pressure fixable microcapsule type toner according to claim 1, wherein said outer wall comprises a resin selected from the group consisting of an epoxy resin, a polyamide resin, a polyurethane resin, a polyurea resin, a vinyl resin, a urethane-urea resin, an epoxy-urea resin and an epoxy-urethane resin.

10. The pressure fixable microcapsule type toner according to claim 9, wherein said outer wall comprises a polyurethan resin, a polyurea resin, a urethan-urea resin, an epoxy-urea resin and an epoxy-urethane resin.

11. The pressure fixable microcapsule type toner according to claim 1, wherein the core material or both the core material and the outer wall contain(s) at least one of (i) a colorant in an amount of from 1 to 20 parts by weight based on 100 parts by weight of the toner and (ii) a magnetic material in the form of micropowder with average particle sizes of 0.1 to 1 micron and in an amount ranging from 20 to 70 parts by weight per 100 parts by weight of the toner.

12. The pressure fixable microcapsule type toner according to claim 11, wherein the powder of said magnetic material is used together with a coupling agent, or has been treated with the coupling agent before use.

13. The pressure fixable microcapsule type toner according to claim 1, wherein the toner is prepared by encapsulation method selected from the group consisting of spray drying method, interfacial polymerization method, coacervation method, in-situ polymerization method and phase separation method.

14. The pressure fixable microcapsule type toner according to claim 14, wherein the toner is prepared by interfacial polymerization method.

15. A pressure fixable microcapsule type toner comprising a core material and an outer wall covering over said core material, said core material comprising a combination of (i) a substance (a) having a glass transition point within the range of from −90° C. to 5° C. or a mixed substance system (a') having a glass transistion point as the whole system within the range of from −90° C. to 5° C., with (ii) a substance (b) having a softening point within the range of from 25° C. to 180° C. or a mixed substance system (b') having a softening point as the whole system within the range of from 25° C. to 180° C.; said substance (i) being in an amount of 60 to 90% by weight of said core material; and said outer wall comprising a resin selected from the group consisting of an epoxy resin, a polyamide resin, a polyurethane resin, a polyurea resin, a vinyl resin, a urethane-urea resin, an epoxy-urea resin and an epoxy-urethane resin.

16. The pressure fixable microcapsule type toner according to claim 15, wherein said substance (a) is selected from the group consisting of polymer of 1-chloro-1-butenylene, isoprene or 1-butenylene; polymer of butene, isobutylene, isohexylethylene or propylene; polymer of butyl acrylate, sec-butyl acrylate, iso-butyl acrylate, ethyl acrylate, 2-ethylhexyl acrylate, heptyl acrylate, 2,2,3,3,5,5,5-heptafluro-4-oxapentyl acrylate, hexyl acrylate or dodecyl acrylate; polymer of decyl methacrylate, dodecyl methacrylate, hexyl methacrylate or 2-ethylhexyl methacrylate; polymer of butyl vinyl ether, 2-ethylhexyl vinyl ether or methyl vinyl ether; polymer of 4-(2-butoxy-ethoxy)methylstyrene, 4-decylstyrene or 4-octyloxymethylstyrene; polymer of oxy-2-butenyleneoxycarbonyl iminohexanmethyleneiminocarbonyl, oxy-2-butenyleneoxycarbonyliminohexamethyleneiminocarbonyl or oxy-2,2-diethyltrimethyleneoxycarbonylimino-4-methyl-1,3-phenyleneiminocarbonyl; polymer of oxymethyl-3,3,3-trifluoropropylsilylene or oxymethylphenylsilylene; styrene-butadiene rubber, acrylonitrile-butadiene rubber or ethylene-propylene rubber; or a copolymer of any of these monomers together with or without other monomers; and said substance (b) is selected from the group consisting of styrene, o-methylestyrene, m-methylstyrene, p-methylstyrene, p-ethylstyrene, 2,4-dimethylstyrene, p-n-butylstyrene, p-tert-butylstyrene, p-n-hexylstyrene, p-n-ocylstyrene, p-n-nonylstyrene, p-n-decylstyrene, p-n-dodecylstyrene, p-methoxystyrene, p-phenylstyrene, p-chlorostyrene, 3,4-dichlorostyrene, ethylene, propylene, butylene, isobutylene, vinyl chloride, vinylidene chloride, vinyl bromide, vinyl fluoride, vinyl acetate, vinyl propionate, vinyl benzoate, vinyl butyrate, methyl acrylate, ethyl acrylate, n-butyl acrylate, isobutyl acrylate, propyl acrylate, n-octyl arylate, dodecyl acrylate, 2-ethylhexyl acrylate, stearyl acrylate, 2-chloroethyl acrylate, phenyl acrylate, methyl α-chloroacrylate, methyl methacrylate, ethyl methacrylate, propyl methacrylate, n-butyl methacrylate, isobutyl methacrylate, n-octyl methacrylate, dodecyl methacrylate, 2- ehtylhexyl methacrylate, stearyl methacrylate, phenyl metharylate, dimethylaminoethyl methacrylate, diethylaminoethyl methacrylate, acrylonitrile, methacrylonitrile, acrylamide, vinyl methyl ether, vinyl ethyl ether, vinyl isobutyl ether, vinyl methyl ketone, vinyl hexyl ketone, methyl isopropenyl ketone, N-vinylpyrrole, N-vinylcarbazole, N-vinylindole, N-vinylpyroolidone, 4-vinylpyridine, 2-vinylpyridine, and a copolymer of any of these monomers.

17. The pressure fixable microcapsule type toner according to claim 16, wherein said mixed substance system (a') is a mixture of a plasticizer selected from the group consisting of dibutyl phthalate, N-ethyl-o,p-toluenesulfonamide, butylbenzyl phthalate and tricresyl phosphate, and a substance having a glass transition point exceeding 5° C.; and said mixed substance system (b') is a mixture of a plasticizer selected from the group consisting of dibutyl phthalate, N-ethyl-o,p-toluenesulfonamide, butylbenzyl phthalate and tricresyl phosphate, and a substance having a glass transition point exceeding 180° C.

18. The pressure fixable microcapsule type toner according to claim 17, wherein said substance (a) or (a') has a glass transistion point ranging from −80° C. to −10° C. and said substance (b) or (b') has a softening point ranging from 35° C. to 170° C.; and said outer wall comprises a polyurethane resin, a polyurea resin, a urethane-urea resin, an epoxy-urea resin and an epoxy-urethane resin.

19. The pressure fixable microcapsule type toner according to claim 18, wherein the core material or both the core material and the outer wall contain (s) at least one of (i) a colorant in an amount of from 1 to 20 parts by weight based on 100 parts by weight of the toner and (ii) a magnetic material in the form of micro-powder with average particle sizes of 0.1 to 1 micron and in an amount ranging from 20 to 70 parts by weight per 100 parts by weight of the toner.

* * * * *